US005195665A

United States Patent [19]

Lina

[11] Patent Number: 5,195,665

[45] Date of Patent: Mar. 23, 1993

[54] CLOSABLE PUSHBUTTON HAVING MULTIPLE JETS

[75] Inventor: Jean-Pierre Lina, Le Neubourg, France

[73] Assignee: Valois (société anonyme), Le Neubourg, France

[21] Appl. No.: 817,384

[22] Filed: Jan. 6, 1992

[30] Foreign Application Priority Data

Jan. 7, 1991 [FR] France ..... 91 00123

[51] Int. Cl.[5] ..... B05B 1/30

[52] U.S. Cl. ..... 222/496; 222/321; 222/330; 222/380; 222/402.1; 239/533.1; 239/570

[58] Field of Search ..... 222/494–497, 222/321, 330, 383, 380, 378, 385, 402.1, 394, 396; 239/533.1, 533.15, 570, 583

[56] References Cited

U.S. PATENT DOCUMENTS

| | | | |
|---|---|---|---|
| 2,109,397 | 2/1938 | McLaughlin | 222/496 |
| 2,170,588 | 8/1939 | Douglas | 222/496 |
| 2,607,515 | 8/1952 | Felburg | 222/496 |
| 4,723,725 | 2/1988 | Comment | 222/496 X |
| 4,830,284 | 5/1989 | Maerte | 222/321 X |

FOREIGN PATENT DOCUMENTS

| | | | |
|---|---|---|---|
| 107080 | 6/1943 | Austria | 222/496 |
| 944944 | 4/1949 | France | 222/496 |
| 163205 | 10/1933 | Switzerland | 222/496 |
| 186698 | 12/1936 | Switzerland | 222/496 |
| 311443 | 1/1956 | Switzerland | 222/496 |
| 9107334 | 5/1991 | World Int. Prop. O. | 222/402.1 |

*Primary Examiner*—Kevin P. Shaver
*Attorney, Agent, or Firm*—Sughrue, Mion, Zinn, Macpeak & Seas

[57] ABSTRACT

A pushbutton for a fluid dispenser includes a chamber 39 provided with three outlet orifices 5, and at least one cylindrical cavity 24 having an axis of symmetry 2. A piston 31 secured to three outlet closures is slidably received in the cylindrical cavity, and is urged by spring 37 to cause the three closures to seat and seal against the orifices. The piston is pushed back by the pressure of the fluid substance emitted by a dispenser to open the orifices, and is extended towards the outlet orifices by a rod 32 having a degree of flexibility. The closures are constituted by three valve pins 35 secured to the rod, each having a tip 36; 36' configured to close one of the orifices.

10 Claims, 2 Drawing Sheets

FIG.1
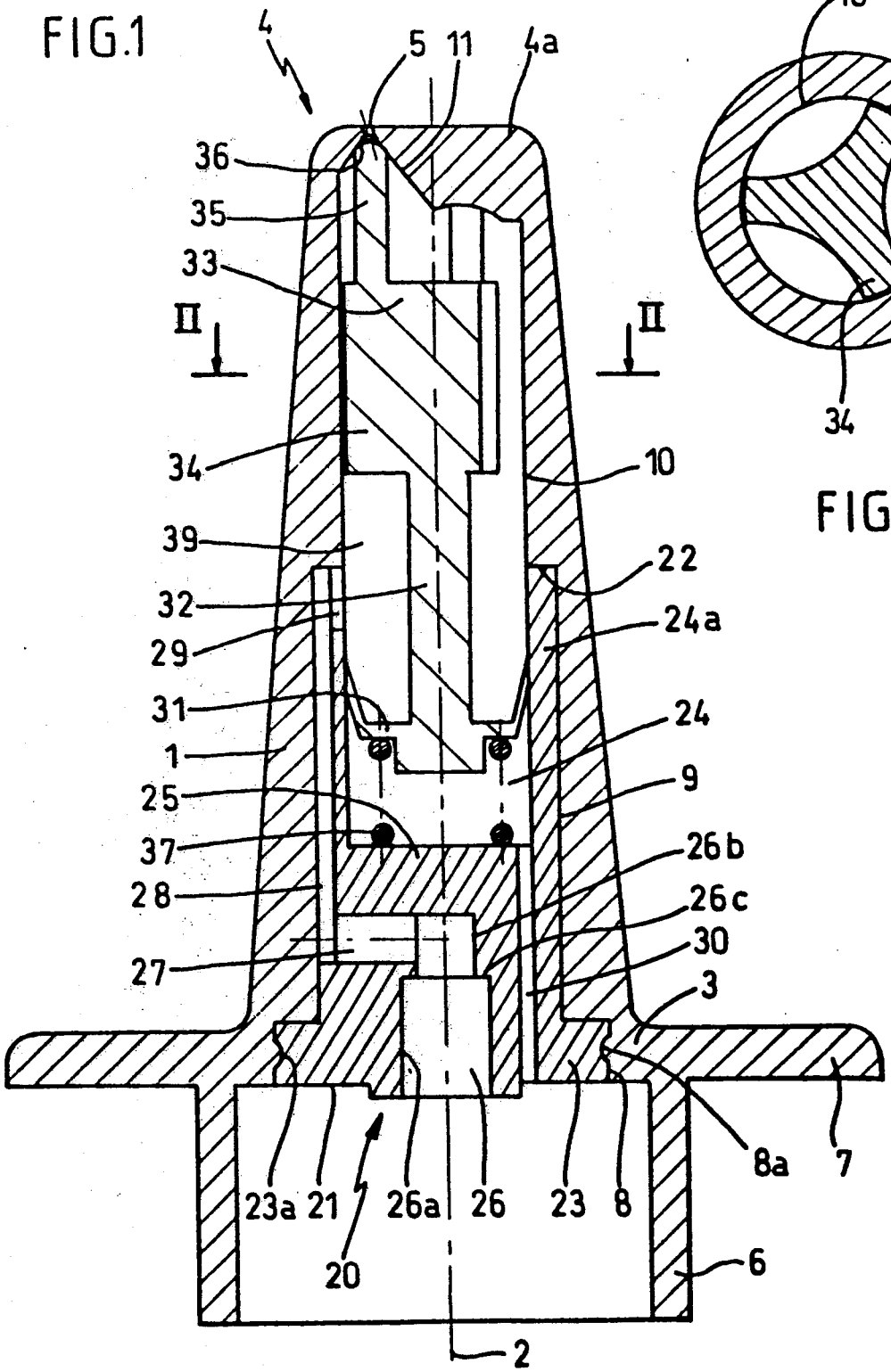
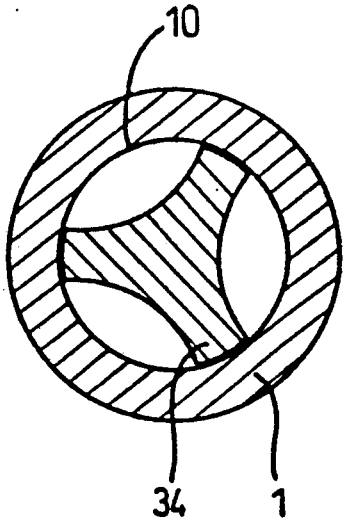
FIG.2

FIG. 3
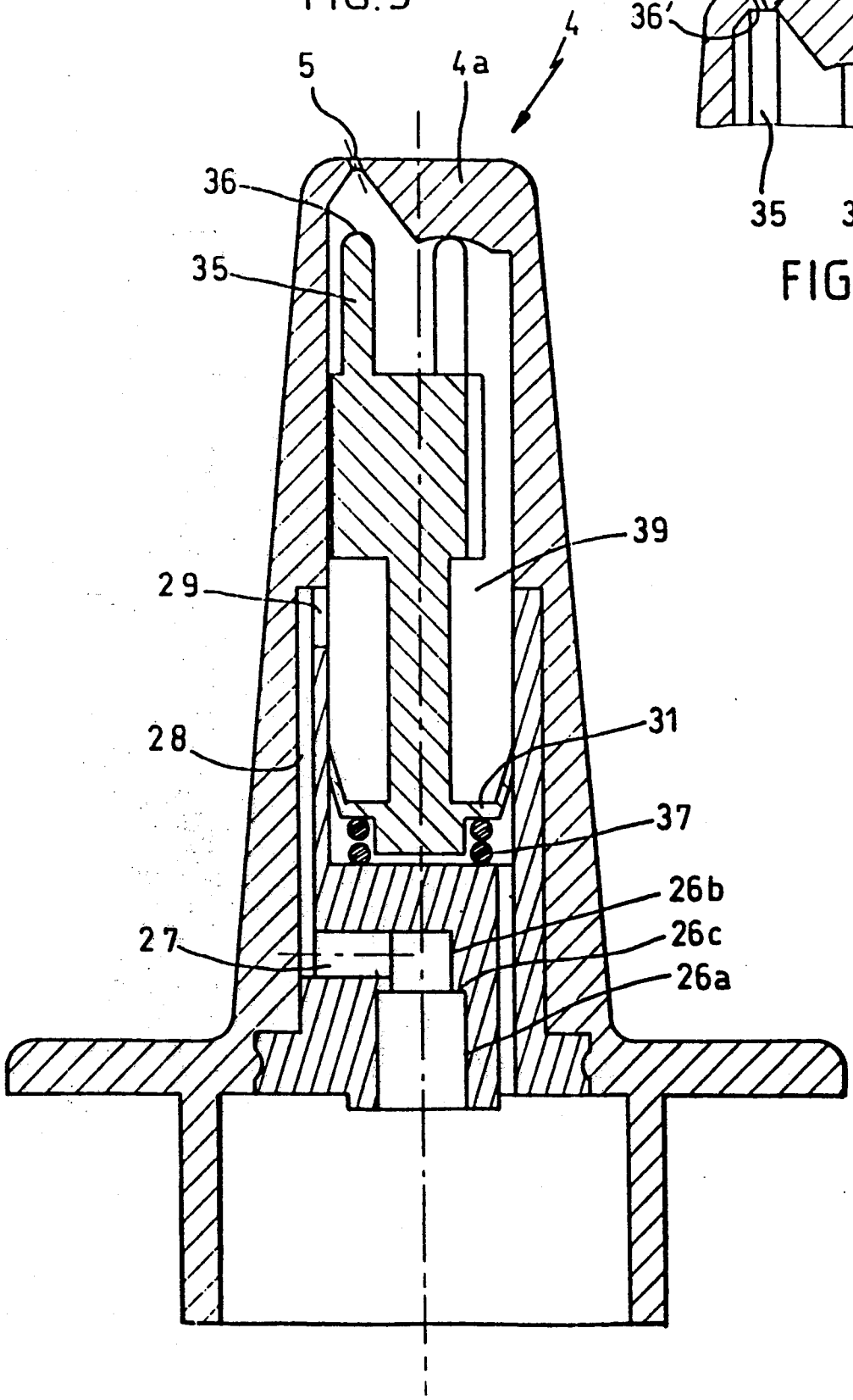
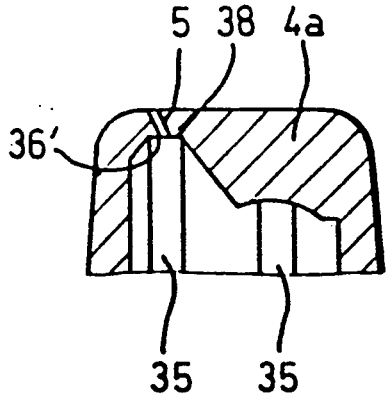
FIG. 4

CLOSABLE PUSHBUTTON HAVING MULTIPLE JETS

BACKGROUND OF THE INVENTION

The present invention relates to a multiple jet pushbutton that is closable and that is designed to be fitted to a hand-held dispenser or spray for use with a fluid. Such pushbuttons are used in particular for spraying a pharmaceutical preparation into the nose of a patient, but they may be used in other applications.

A technical problem that arises with all such pushbuttons is to prevent contact between outside air and the substance contained in the pushbutton, for the purposes of preventing the substance drying out, of preventing it being oxidized by oxygen in the air, or preventing it being polluted.

This problem has been solved in various different ways for conventional pushbuttons that include one outlet orifice only. For example, European patent application No. 0129643 describes a pushbutton including a cylindrical duct provided with an outlet end including an outlet orifice and slidably receiving a piston secured to a punch that points towards the outlet orifice, the piston being resiliently urged towards a position where the punch closes the outlet orifice and being suitable for being urged towards a position in which the outlet orifice is opened by the action of pressure from a fluid to be sprayed.

In a multiple jet pushbutton, the substance is ejected via a plurality of outlet orifices. Clearly, each of the outlet orifices could be closed by a respective closure means, but that gives rise to two technical problems:

1/how to ensure simply that each closure means faces an outlet orifice without complicating assembly of the pushbutton; and 2/how to guarantee that all of the closed outlet orifices are sealed without requiring impractical manufacturing tolerances and without complicating the apparatus.

An object of the present invention is to solve these technical problems. It should be observed that such pushbuttons are generally discarded after the supply of substance in the spray has been used up. The technical solution adopted must therefore necessarily be cheap.

SUMMARY OF THE INVENTION

The present invention thus provides a pushbutton for a fluid dispenser, the pushbutton including a chamber provided with an outlet and at least one cylindrical portion having an axis of symmetry, a piston secured to outlet closure means being slidably received in said cylindrical portion, said piston being urged by resilient means to cause the closure means to close the outlet, and said piston being suitable for being pushed back by the pressure of the fluid substance emitted by a dispenser so as to open said outlet. The pushbutton outlet is constituted by three outlet orifices, the piston being extended towards said outlet orifices by a rod having a degree of flexibility, and the closure means being constituted by three valve pins secured to the rod and each including a tip suitable for closing one of the outlet orifices. Advantageously, the rod has a degree of bending flexibility. In an advantageous embodiment of the invention, the pushbutton includes a cylindrical duct extending the cylindrical portion in which the piston slides towards the outlet orifices, and the valve pins are formed on radial arms which extend from the rod and which slide with a certain amount of clearance inside the cylindrical duct. In addition, the pushbutton may include an end wall in which the outlet orifices are formed, said end wall having a surface on the inside or directed towards the valve pins comprising three conical surfaces each converging on a respective one of the outlet orifices and diverging towards said valve pins. The outlet orifices may be disposed at 120° relative to one another about the axis, and at the same distance from the axis, and the valve pins may likewise be disposed at 120° to one another, and at the same distance from the axis as the outlet orifices. Advantageously, the tip of each valve pin is hemispherical in shape and bears in sealed manner against one of the conical surfaces surrounding one of the outlet orifices, or else the tip of each valve pin is plane, and each outlet orifice is surrounded by a flat facing the plane tip of one of the valve pins, said flat being parallel to said plane tip. In an embodiment of the invention, the pushbutton includes a hollow body having an outlet end in which the outlet orifices are formed, and an open end in which a socket is received, said socket including an end wall which closes the open end of the body and which is extended towards the outlet end by a solid portion and then by a cylindrical wall in which the piston slides. Advantageously, the solid portion of the socket includes a blind bore for receiving an actuator rod of the dispenser serving to emit the substance, the bore being in communication with a side channel which opens out into outside fluting of the socket which in turn opens out via an opening through the cylindrical wall of the socket between the piston and the outlet end of the body. In addition, said solid portion of the socket may be pierced by a vent channel which opens out between the piston and said solid portion and which is in communication with the atmosphere.

Other characteristics and advantages of the invention appear from the following detailed description of a particular embodiment of the invention given by way of non-limiting example and described with reference to the accompanying drawings.

BRIEF DESCRIPTION OF THE DRAWINGS

In the drawings:

FIG. 1 is a longitudinal section through a pushbutton constituting an embodiment of the invention, shown in its closed position;

FIG. 2 is a fragmentary cross-section view on line II—II of FIG. 1;

FIG. 3 is a longitudinal section view through the FIG. 1 pushbutton when in the open position; and FIG. 4 is a fragmentary longitudinal section through a variant of the FIG. 1 pushbutton.

DETAILED DESCRIPTION OF THE PREFERRED EMBODIMENTS

With reference to FIG. 1, the pushbutton may comprise a frustoconical body 1 that may be made of molded plastic, having an axis of revolution 2, and extending between an open end 3 and an outlet end 4 of smaller diameter than the end 3. The end 3 includes a cylindrical inside recess 8 which is advantageously provided with an internal peripheral lip 8*a*. The recess 8 is extended towards the outlet end 4 by a first cylindrical duct 9 of smaller diameter than said recess, and said first cylindrical duct 9 is itself extended by a second cylindrical duct 10 of smaller diameter than said first cylindrical duct 9 to an end wall 4a at the outlet end 4. The end wall 4a is pierced by three outlet orifices 5 at 120° intervals from one another about the axis 2 and equidistant from the axis 2. The outlet orifices 5 may slope relative to the axis 2 so as to produce diverging jets when a substance is emitted by the pushbutton. The end wall 4a also includes an inside surface which is subdivided into three conical surfaces 11 about axes parallel to the axis 2 and each converging on a respective outlet orifice 5, said conical surfaces flaring towards the end 3 of the body 1.

The open end 3 of the pushbutton may include a thrust ring 7 projecting radially outwards and enabling a user to actuate the pushbutton with two fingers. In addition, the open end 3 of the pushbutton may include a skirt 6 extending axially away from the end 4 so as to surround a spray valve or pump on which the pushbutton is mounted.

A socket 20 that may be made of molded plastic extends between an end wall 21 and an open end 22, and its outside diameter is equal to the diameter of the first cylindrical duct 9. The socket is engaged as a tight fit in said cylindrical duct 9 and it occupies the entire length of said duct 9. The end wall 21 of the socket 20 is extended outwardly by a flange 23 which is complementary in shape to the cylindrical recess 8 of the body 1 and it engages in said cylindrical recess 8. In addition, the flange 23 includes a peripheral groove 23a which is complementary in shape to the lip 8a and into which said lip 8a snaps when the flange 23 is engaged in the cylindrical recess 8.

The socket 20 includes a cylindrical cavity 24 centered on the axis 2 and which extends over a fraction of the length of said socket between a solid portion 25 and its open end 22. This cylindrical cavity is delimited by a cylindrical side wall 24a whose inside diameter is equal to the inside diameter of the cylindrical duct 10.

The solid portion 25 of the socket 20 is provided with a central blind bore 26 which opens out into the end wall 21 of the socket 20. Starting from the end wall 21 of the socket, the bore 26 comprises a first cylindrical portion 26a followed by a smaller diameter second cylindrical portion 26b separated therefrom by a shoulder 26c. The portion 26b of the bore 26 communicates with a radial side channel 27 which opens out into fluting 28 on the outside of the socket 20 and extending parallel to the axis 2. The fluting 28 extends from the side channel 27 to the open end 22 of the socket 20 where the cylindrical side wall 24a of said socket includes an opening 29 putting said fluting 28 into communication with the cylindrical cavity 24 of the socket.

In addition, the solid portion 25 of the socket includes an off-axis vent channel 30 which runs through said solid portion parallel to the axis 2 and which puts the cylindrical cavity 24 into communication with the atmosphere.

The pushbutton of the invention also includes a piston 31 slidably received in the cylindrical cavity 24 of the socket and extended towards the outlet end of the pushbutton by an axial rod 32 having a certain degree of bending flexibility. The rod 32 extends from the piston 31 to an end 33 close to the outlet end 4, said end 33 having three radial arms 34 at 120° intervals from one another about the axis 2 and sliding with a degree of clearance inside the second cylindrical duct 10 of the pushbutton (see FIG. 2). Each arm 34 carries a small diameter valve pin 35 which is disposed at the same distance from the axis 2 as the outlet orifices 5 of the pushbutton, and which extends parallel to the axis 2 towards the outlet end 4 of the pushbutton to a tip 36 suitable for closing the outlet orifice 5. The three valve pins 35 are identical in length and together with the three arms 34 they constitute a rigid assembly. The piston 31, the rod 32, the arms 34, and the valve pins 35 may be molded out of plastic.

A helical spring 37 or any other resilient means, e.g. integral with the solid portion 25, is disposed between the solid portion 25 of the socket 20 and the piston 31 so as to urge the assembly constituted by the piston 31, the rod 32, the arms 34, and the valve pins 35 resiliently towards the outlet end 4. Thus, in the absence of any external action, the valve pins 35 are urged against the end wall 4a and they are guided towards the outlet orifices 5 by the three cones 11 which constitute the inside surface of said end wall: if the relative angular position between the body 1 and the piston 31 while the pushbutton is being assembled is such that the three valve pins 35 are not in line with the three outlet orifices 5, then the resilient flexing of the valve pins 35 against the cones 11 will rotate the assembly constituted by the piston 31, the rod 32, the arms 34, and the valve pins 35 simultaneously with said assembly being pushed towards the outlet end 4 until the tips 36 of the three valve pins 35 close respective ones of the three outlet orifices 5. There is thus no need for accurate angular positioning of the assembly constituted by the piston 31, the rod 32, the arms 34, and the valve pins 35 relative to the body 1 when assembling the pushbutton: assembly is therefore simple and requires conventional tooling only.

As shown in FIG. 1, the tips 36 of the valve pins 35 may be rounded so as to be hemispherical in shape, which shape co-operates with the cones 11 to close the outlet orifices 5 in a sealed manner. Alternatively, as shown in FIG. 4, the tips 36' may be planar and perpendicular to the axis 2, and the end wall 4a of the pushbutton may include flats 38 surrounding each of the outlet orifices 5 and facing said tips 36' of the valve pins 35, the widths of said flats 35 being identical to the widths of said tips 36'. Nevertheless, the tips of the valve pins 35 may be of any other shape without going beyond the scope of the invention.

Because of manufacturing tolerances, the lengths of the valve 75 pins 35 may be slightly different, or the inside surface of the end wall 4a may have cones 11 that are not all in exactly the same positions along the axis 2. According to the invention, the three tips 36 of the valve pins 35 can make sealed contact with the end wall 4a, thereby each closing one of the outlet orifices 5, under any such circumstances: under drive from the spring 37, the rigid assembly constituted by the three arms 34 and the three valve pins 35 can tilt by bending deformation of the rod 32 so that each valve pin tip closes one of the orifices 5. This tilting which causes the arms to be slightly skewed inside the cylindrical duct 10 is made possible by leaving clearance between the arms 34 and the cylindrical duct 10. It should also be observed that the closing of all of the outlet orifices 5 is guaranteed only because they are three in number: if there were more than three outlet orifices 5 together with a corresponding number of valve pins, it would only be certain that three of the orifices were properly closed, since once three valve pins bear properly against the end wall, the position of the set of valve pins is determined.

The manufacturing tolerances to be taken up by tilting the rigid assembly constituted by the three arms 34 and the three valve pins 35 are generally small and as a result the angular deflection of the arms 34 is small: a small amount of play between said arms 34 and the cylindrical duct 10 therefore suffices to enable the arms 34 to tilt as required.

Because of the tilting, the valve pins 35 are no longer exactly parallel to the axis 2. When the tips 36 of the valve pins are hemispherical (FIG. 1) and when they are applied against cones 11, this has no detrimental effect on the sealing provided by the contact between each hemispherical tip 36 and the corresponding cone 11. However, when the tips 36' are planar (FIG. 4) and bear against flats 38 formed around the outlet orifices 5, because the angular tilt of the valve pins relative to the axis 2 is small and because said valve pins are small in diameter, the clearance thus left between the flats 38 and the planar tips 36' is very small and may be taken up by deformation of the tips 36' and/or by bending of the valve pins 35 such that the tips 36' of the valve pins close the outlet orifices 5 in a sealed manner.

OPERATION

The pushbutton of the invention can be used on a manual spray or dispensing pump or on an aerosol valve including a hollow actuating rod (not shown) through which a fluid is emitted. The actuating rod is engaged in the first cylindrical portion **26*a* of the blind bore 26, coming into abutment against the shoulder 26*c***.

At rest, i.e. when there is no external force applied, the tips 36 of the valve rods 35 close the outlet orifices 5 as described above, and the piston 31 is in a position situated between the opening 29 through the cylindrical wall **24*a* and the solid portion 25 of the socket 20, such that the opening 29 is in communication with the cylindrical chamber 39 delimited by the piston 31, the cylindrical wall 24*a* of the socket, the second cylindrical duct 10 of the body 1, and the end wall 4*a***.

When a user presses on the ring 7 of the pushbutton, the shoulder **26*c* bears against the actuator rod of the pump or of the spray valve and as a result fluid is emitted along said actuator rod into the second cylindrical portion 26*b* of the blind bore 26 and at a relatively high pressure. The substance passes through the side channel 27, the fluting 28, the opening 29, and penetrates into the cylindrical chamber 39**.

Because the substance is under pressure, the piston 31 is urged towards the solid portion 25 of the socket 20 and it takes the valve pins 35 with it, thereby opening the outlet orifices (cf. FIG. 3). The substance is then emitted via the three outlet orifices 5. When the piston 31 is pushed towards the massive portion 25 of the socket, a fraction of the air compressed between said piston 31 and said solid portion 25 is expelled via the vent channel 30.

When the user ceases to press on the ring 7, substance ceases to be emitted via the actuator rod for the pump or the valve and as a result the pressure inside the cylindrical chamber 39 drops. The spring 37 then urges the piston towards the outlet end 4 until the three valve pins 35 close the three outlet orifices 5 as described above. The substance contained in the pushbutton is then isolated from the atmosphere and is thus sheltered from drying out, from oxidizing, or from pollution. It should be observed that the spring 37 which is generally made of metal is not in contact with the substance: there is therefore no danger of the spring polluting the substance.

Naturally, the pushbutton of the invention may equally well be organized so that its axis 2 does not coincide with the axis of the actuator rod for the pump or the valve as in the example described, for example the axis 2 could be perpendicular to the actuator rod.

I claim:

1. A pushbutton for a fluid dispenser, the pushbutton comprising: means defining a chamber (39) provided with three outlet orifices (5), and at least one cylindrical cavity (24) having an axis of symmetry (2), a piston (31) secured on one side thereof to outlet closure members and slidably disposed in said cylindrical cavity, and resilient means (37) engaging another, opposite side of the piston for biasing the piston and therewith the closure members in a first direction to close the outlet orifices, said piston and closure members being movable in a second, opposite direction in response to pressure in the chamber of a fluid substance to be emitted by the dispenser to open said outlet orifices, and wherein the piston is extended towards said outlet orifices by a flexible rod (32), and the closure members comprise three valve pins (35) secured to the rod and each including a tip (36; 36') configured to close one of the outlet orifices.

2. A pushbutton according to claim 1, wherein the flexible rod (32) can bend transverse to said axis.

3. A pushbutton according to claim 1, wherein a cylindrical duct (10) extends the cylindrical cavity (24) in which the piston slides towards the outlet orifices, and the valve pins (35) are formed on radial arms (24) which extend from the rod (32) and which slide with a clearance inside the cylindrical duct.

4. A pushbutton according to claim 1, wherein the outlet orifices (5) are formed in an end wall (**4*a*) of the means defining a chamber, said end wall having an inner surface directed towards the valve pins (35) defining three conical recesses (11**) each converging on a respective one of the outlet orifices and diverging towards said valve pins.

5. A pushbutton according to claim 1, wherein the outlet orifices (5) are disposed at 120° relative to one another about the axis of symmetry (2), and are at an equal distance from said axis, and the valve pins (35) are likewise disposed at 120° to one another, and at an equal distance from said axis as the outlet orifices.

6. A pushbutton according to claim 4, wherein the tip (36) of each valve pin is hemispherical in shape and bears in sealed manner against one of the conical recesses (11) surrounding one of the outlet orifices.

7. A pushbutton according to claim 1, wherein the tip (36') of each valve pin is planar, and each outlet orifice is surrounded by a flat (38) facing the planar tip of one of the valve pins, said flat (38) being parallel to said planar tip.

8. A pushbutton according to claim 1, further wherein said means defining a chamber comprises a hollow body (1) having an outlet end (4) in which the outlet orifices (5) are located, and an open end (3) in which a socket (20) is located, said socket (20) including an end wall (21) which closes the open end of the body and which is extended towards the outlet end by a solid portion (25) followed by a cylindrical wall (**24*a*) in which the piston (31**) slides.

9. A pushbutton according to claim 8, wherein the solid portion (25) of the socket includes a blind bore (26) for receiving an actuator rod of the dispenser serving to emit the fluid substance, the bore being in communication with a side channel (27) which opens out into outside fluting (28) of the socket which in turn opens out via an opening (29) through the cylindrical wall (24*a*) of the socket between the piston and the outlet end of the body.

10. A pushbutton according to claim 8, wherein the solid portion (25) of the socket includes a vent channel (30) which open out between the piston and said solid portion and which is in communication with the atmosphere.

* * * * *